United States Patent [19]

Hayano et al.

[11] Patent Number: 4,673,339

[45] Date of Patent: Jun. 16, 1987

[54] SCROLL COMPRESSOR WITH SUCTION PORT IN STATIONARY END PLATE

[75] Inventors: Makoto Hayano; Shigemi Nagatomo, both of Tokyo; Hirotsugu Sakata, Chigasaki; Mitsuo Hatori, Yokohama; Hitoshi Hattori, Yokosuka, all of Japan

[73] Assignee: Kabushiki Kaisha Toshiba, Kawasaki, Japan

[21] Appl. No.: 896,347

[22] Filed: Aug. 14, 1986

Related U.S. Application Data

[63] Continuation of Ser. No. 725,334, Apr. 19, 1985, abandoned.

[30] Foreign Application Priority Data

Jul. 20, 1984 [JP] Japan ..... 59-150817

[51] Int. Cl.[4] ..... F04C 18/04

[52] U.S. Cl. ..... 418/15; 418/55

[58] Field of Search ..... 418/15, 55, 57

[56] References Cited

U.S. PATENT DOCUMENTS

| | | | |
|---|---|---|---|
| 3,011,694 | 12/1961 | Audemar | 418/55 |
| 3,884,599 | 5/1975 | Young et al. | 418/55 |
| 3,994,633 | 11/1976 | Shaffer | 418/5 |
| 4,065,279 | 12/1977 | McCullough | 62/510 |
| 4,216,661 | 8/1980 | Tojo et al. | 418/55 |
| 4,431,380 | 2/1984 | Utter | 418/55 |
| 4,431,388 | 2/1984 | Eber et al. | 418/55 |
| 4,494,914 | 1/1985 | Shiibayashi . | |
| 4,496,296 | 1/1985 | Arai et al. . | |
| 4,522,575 | 6/1985 | Tischer et al. | 418/55 |
| 4,545,747 | 10/1985 | Tamura et al. | 418/55 |

FOREIGN PATENT DOCUMENTS

| | | | |
|---|---|---|---|
| 0060140 | 9/1982 | European Pat. Off. . | |
| 3300838 | 7/1983 | Fed. Rep. of Germany . | |
| 3312280 | 10/1983 | Fed. Rep. of Germany . | |
| 57-70984 | 5/1982 | Japan | 418/55 |
| 57-153984 | 9/1982 | Japan | 418/15 |
| 58-101288 | 6/1983 | Japan | 418/55 |

*Primary Examiner*—John J. Vrablik

*Attorney, Agent, or Firm*—Schwartz, Jeffery, Schwaab, Mack, Blumenthal & Evans

[57] ABSTRACT

In a scroll compressor, at least one suction port for gas is opened in a stationary end plate which has a spiral wrap. Gas is drawn directly into the compression chambers from the suction port. In addition, the suction port has an opening straddling both the radially extending surface of the stationary end plate at the outermost circumference of the compression chambers and the compression chamber side wall that is perpendicular to the radially extending surface, and the opening area of the suction port is relatively large.

11 Claims, 4 Drawing Figures

SCROLL COMPRESSOR WITH SUCTION PORT IN STATIONARY END PLATE

This application is a continuation, division, of application Ser. No. 725,334, filed Apr. 19, 1985, abandoned.

TECHNOLOGICAL FIELD OF THE INVENTION

This invention relates to a scroll compressor, more specifically, to a higher pressure-type scroll compressor in which the gas to be compressed can be drawn in efficiently.

TECHNOLOGICAL BACKGROUND OF THE INVENTION

A scroll compressor comprises two disk-like end plates, each having a spiral wrap at one side thereof, facing each other. The two wraps are in contact along several contact lines, forming a plurality of compressor chambers therebetween. In the scroll compressor, one end plate revolves around the other stationary end plate in an eccentric orbit, so that the contact lines gradually shift from the outer circumference toward the inner circumference. The gas that is drawn into the compression chambers between the two wraps is gradually compressed from the outer circumference toward the inner circumference.

There are basically two types of scroll compressor: a lower pressure type, in which the inside of the vessel is maintained at lower pressure, as in U.S. Pat. Nos. 3,011,694 and 4,065,279, and a higher pressure type, in which there is a higher pressure chamber on the opposite side to the compression chamber of the orbiting end plate, as in U.S. Pat. Nos. 3,884,599 and 3,994,633.

In general, in a higher pressure type scroll compressor, a rotation drive device such as a motor and a compression device to compress the gas are installed inside a sealed vessel. The gas (such as air) to be compressed passes through a guide tube which is inserted into the sealed vessel, and enters the compression chamber from one or more inlets on the outer circumference of the compressor. After the compressed gas at a high pressure from the compression chamber has passed through each part of the interior of the sealed vessel, it is exhausted out of the sealed vessel to the outside. Consequently, since the entire sealed vessel is heated by the heat generated when the gas is compressed, if the path of the drawn gas is long from its inlet or suction through the sealed vessel to the compression chambers, then the drawn gas will be heated. Also, the high pressure inside the sealed vessel acts on the first surface or rear surface of the orbiting end plate, that is, the surface away from the compression chambers, and a strong force presses against the stationary end plate, causing a large friction force to occur between the two end plates so that the drawn-in gas is heated. When the gas drawn in from the suction port is thus heated before it enters the compression chambers, the exhaust mass flow is reduced, thus reducing the compressor capacity.

In addition, in existing modes of scroll compressor, there is another problem as well; gas is always being drawn in so that the part of the gas which misses the timing of the compression cycle accumulates inside the compression section, whereas, when a gas suction port is located near the scroll wrap to make the gas suction intermittent, there is the limitation that the diameter of the gas suction port cannot be made larger than the material thickness of the wrap, so the resistance in the flow path cannot be made small.

The concept of liquid injection, in which cooled liquid passes through the stationary end plate into a compression chamber between the end plates, has already been suggested in the prior art, but the existing technology does not suggest that the gas to be compressed is fed through the stationary end plate.

PURPOSE OF THE INVENTION

The first purpose of this invention is to provide a scroll compressor in which the heating of the gas drawn in from the suction port into the compression device section before it reaches the compression chambers is held to a minimum.

The second purpose of this invention is to provide a scroll compressor in which a port provided for the intermittent section of gas has a larger diameter so that the flow of gas drawn in is increased.

SUMMARY OF THE INVENTION

This invention to achieve the purposes has two features. The first feature of this invention is that a gas intake port is opened in the stationary end plate which has a spiral wrap; gas is drawn directly into the compression chambers through the port.

According to the second feature of this invention, gas can be intermittently drawn in through the suction port corresponding to the movement of the scroll wrap; the suction port is pierced in the statonary end plate of the scroll compressor, and the diameter of the port is larger than the material thickness of the scroll wrap.

BRIEF DESCRIPTION OF THE DRAWINGS

These and other aspects and advantages of the invention will become apparent by reference to the following detailed description of preferred embodiments when considered in conjunction with the accompanying drawing, wherein like numbers correspond to like elements throughout the drawing.

DESCRIPTION OF PREFERRED EMBODIMENTS

Figure 1:
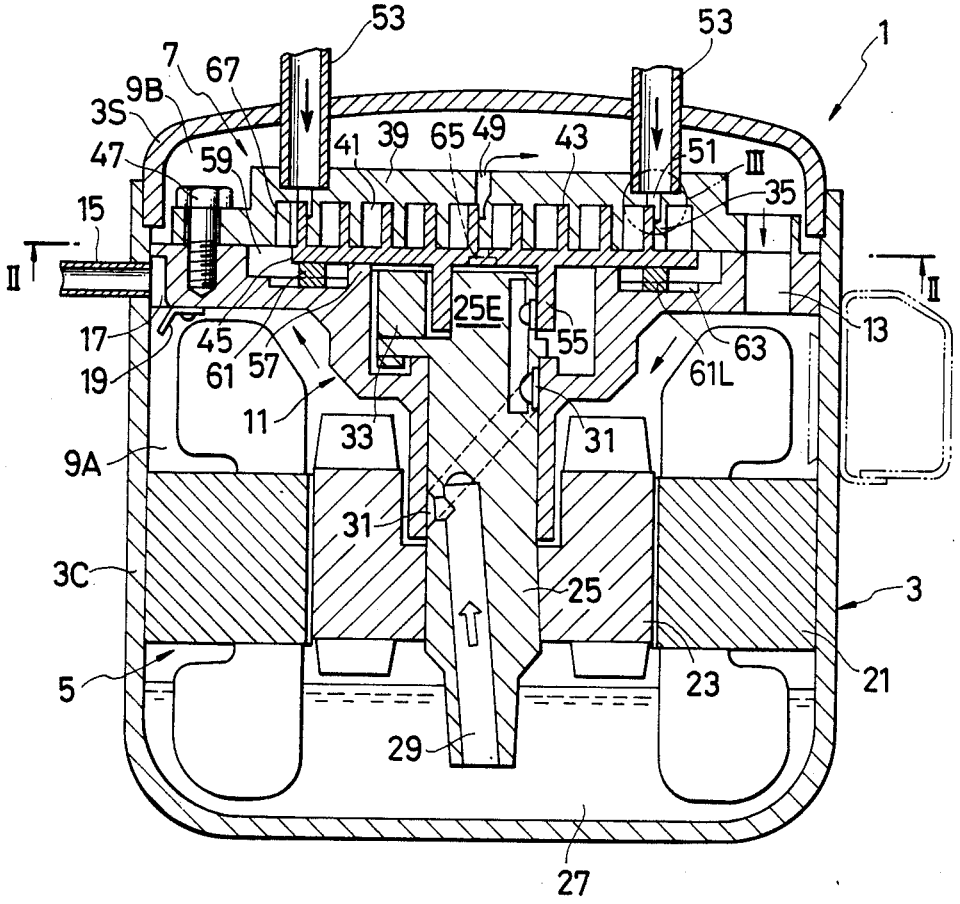
FIG. 1 is a front cross-sectional view of a scroll compressor according to the present invention.

Referring to FIG. 1, the scroll compressor 1 comprises a sealed vessel 3, a rotation drive device 5, such as a motor, installed inside the sealed vessel 3, and a compression device 7 which compresses gas.

The sealed vessel 3 consists of a bottomed cylindrical casing 3C and a seal cover 3S which is sealingly fixed to the casing 3C. Integrally fixed to the inside of the sealed vessel 3 is a substantially disc-shaped frame 11 that divides the interior of the sealed vessel 3 into a drive chamber 9A and a compression device chamber 9B. Pierced in this frame 11 is at least one through-hole 13 which communicates the drive chamber 9A with the compression device chamber 9B. In addition, formed at a location remote from the through-hole 13 is a recessed communicating path 17 which communicates the drive chamber 9A with the exhaust tube 15 mounted to the pressure vessel 3. Disposed near the entrance to this communicating path 17 is a baffle plate 19 which interferes with the direct flow-out of high-pressure gas mixed with oil from the drive chamber 9A to the exhaust tube 15. Also, as the high pressure gas contacts this baffle plate, lubrication oil mixed into the gas adheres to the plate and is separated out from the gas.

The rotation drive device 5 consists of a motor in this embodiment. The stator iron core 21 is integrally mounted to the casing 3C in the drive chamber 9A. The rotor 23 is integrally mounted to the rotating shaft 25 which is supported vertically in the center of the said frame 11. The lower end of the rotating shaft 25 is immersed in the lubricating oil 27 which accumulates in the bottom of the casing 3C. The core of this rotating shaft 25 has a lubricating oil suction hole 29, which sucks up the lubricating oil 27 when the shaft 25 rotates. It will be noted from the drawing that the hole 29 is inclined at a suitable angle to the shaft core. This suction hole 29 is connected to several supply ports 31 at bearing portions where the rotating shaft 25 is supported by the frame 11. In this particular embodiment, the suction hole 29 is inclined, but it can also have another orientation provided that it has a flow path in the radial direction. Formed at the top end of the rotating shaft 25 is the eccentric section 25E which has a suitable eccentricity with respect to the core of the rotating shaft 25. In addition, a balance 33 is mounted off center to maintain equilibrium with the eccentric section 25E and other parts to reduce vibrations.

In the configuration mentioned above, when the rotating shaft 25 rotates, lubricating oil is automatically supplied to the bearing portions where the shaft is supported and other locations where it is needed, so that smooth motion is maintained.

Figure 2A:
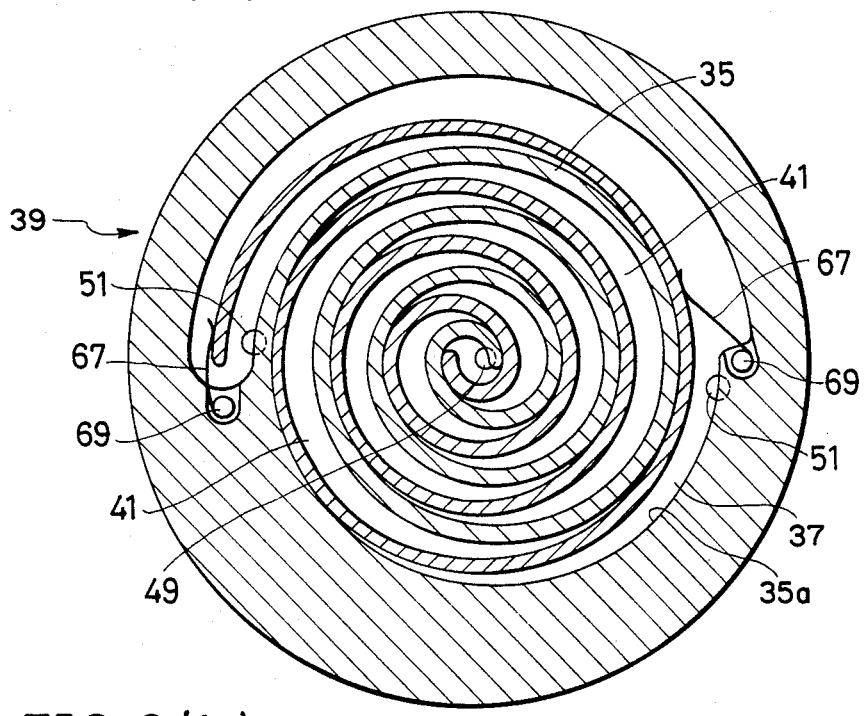
FIGS. 2(*a*) and (*b*) show a cross-sectional view taken along the line II—II in FIG. 1 at different instances of operation and is used to explain the action of the scroll compressor.
Figure 2B:
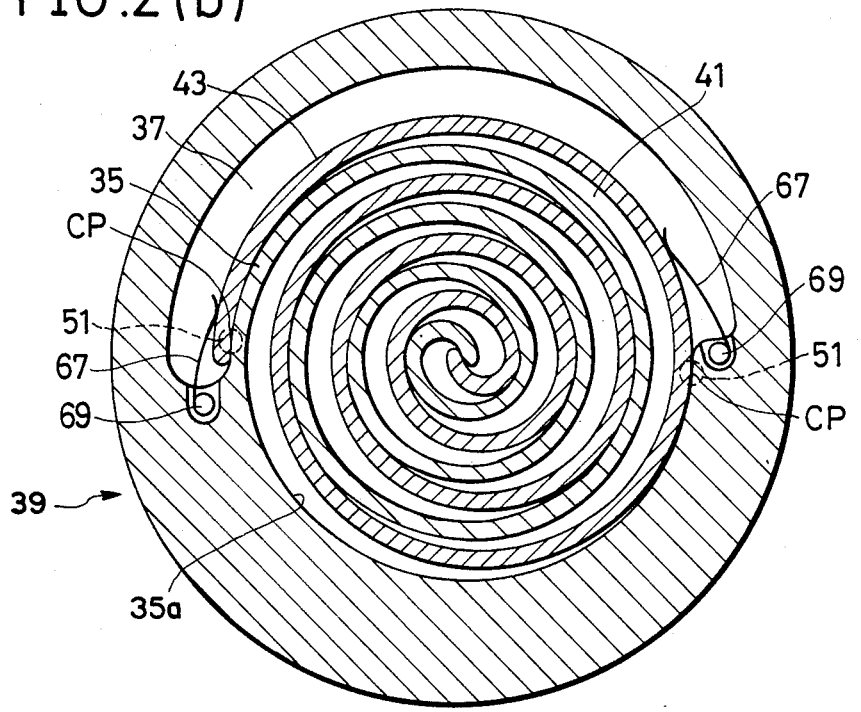

The compression device 7 is positioned inside the compression device chamber 9B, and comprises a disc-shaped stationary end plate 39 which has a first or stationary scroll wrap 35 and a closed space defining a semicircularly shaped suction chamber 37, and a disc-shaped orbiting end plate 45 which has a second or orbiting scroll wrap 43, which slidably contacts the first or stationary scroll wrap 35 in several places, forming closed spaces defining compression chambers 41. The semicircular shape of the suction chamber is shown in FIGS. 2(*a*) and 2(*b*); The rotating shaft 25 is attached to the first surface, that is to say the surface away from the compression chambers, of this orbiting end plate 45.

The stationary end plate 39 is fixed tightly to the frame 11 by several bolts 47. Pierced in the center of this stationary end plate 39 is an ejection port or discharge port 49 through which compressed gas at higher pressure is ejected into the compression device chamber 9B. Also, as shown in FIG. 2(*a*), at a location corresponding to the suction chamber 37 formed by the combination of the first scroll wrap 35 or the outer wall 35*a* of the stationary end plate 39 with the second scroll wrap 43, there is at least one suction port 51 opening on the first surface, that is to say the surface on the compression chamber side, of the stationary end plate 39 so as to draw the gas. A suction tube 53 is connected from the second surface, that is to say the surface away from the compression chambers, of the stationary end plate 39 to this suction port 51. As the second scroll wrap moves from the position shown in FIG. 2(*a*) to that shown in FIG. 2(*b*), the suction ports 51 are closed off, and the gas that was drawn in from the ports 51 is centripetally rotated to a compression chamber 41.

Figure 3:
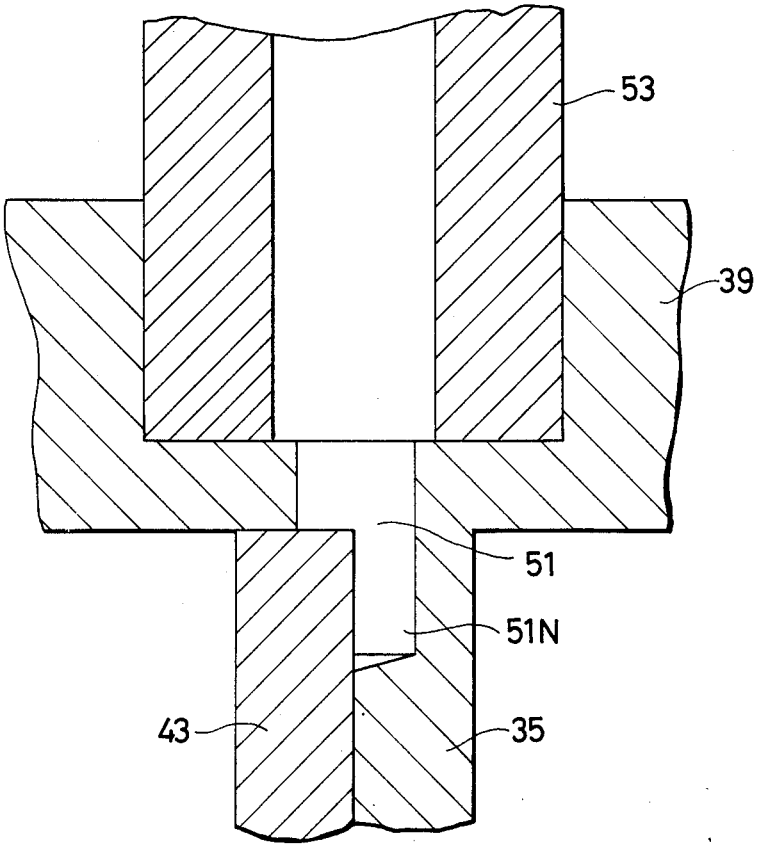
FIG. 3 is an expanded view of section III in FIG. 1.

In the embodiment shown in FIG. 3, the suction port 51 is partly formed with a notch or recess 51N in a portion, specifically a side wall, of the first scroll wrap 35. The notch or recess 51N may alternatively be formed in the outer wall 35*a* of the stationary end plate defining the suction chamber 37. FIGS. 2(*a*) and 2(*b*) show a suction port in each location. The gas drawn into the suction port or ports from a respective suction tube 53 leaves through an opening in the corner at the outermost circumference of the compression chambers, straddling both of the side wall and the radially extending first surface of the end plate. In FIGS. 1 and 2, it can be seen that the suction port is half-hidden by the first scroll wrap 35. The second scroll wrap 43 moves with respect to the suction port, opening the suction port, or contacting the first scroll wrap to close the suction port. In other words, when the second scroll wrap 43 opens the suction port, the opening area of the suction port is as large as possible inside the compression chamber, while when the suction port is closed, the suction port is completely covered by the second scroll wrap so that it is not exposed. In FIG. 2(*a*) the second scroll wrap has moved to the left and the suction port is open; whereas in FIG. 2(*b*) the second scroll wrap has moved to the right and the suction port is closed.

In the construction described above, the diameter of the suction port 51, as shown best in FIG. 3, can be formed to be substantially the same as or larger than the material thickness of the second scroll wrap 43.

In this embodiment, there are two symmetrically located suction ports 51 so that the whole construction of the compression chambers will have point symmetry, increasing the compression efficiency, but it is possible to have only one suction port, or many suction ports, which can be asymmetrically positioned.

The orbiting end plate 45 mentioned above is formed integrally with the second scroll wrap 43, which contacts the first scroll wrap 35 at several locations so that the two are free to slide against each other. Thus the orbiting end plate 45 is combined with the stationary end plate 39 to form compression chambers 41 at several locations between the first surface of the stationary end plate and the second surface of the orbiting end plate, as shown in FIG. 1.

In the center of the first surface of the orbiting end plate 45, a cylindrically-shaped mating section 55 is formed. The eccentric section 25E of the rotating shaft 25 is rotatably mated to the inside of this mating section 55. In addition, the first surface of the orbiting end plate 45 is rotatably supported on the tip of an annular protrusion 57 formed on the frame 11. A lower pressure chamber 59 is formed on the outside of the protrusion 57 in such a way that it is communicated with the suction chamber 37. An Oldham's ring 61 is fitted inside this lower pressure chamber 59. Since the Oldham's ring moves in an environment of relatively lower density, the resistance acting on it is small.

When the orbiting end plate 45 revolves, the Oldham's ring 61 acts to keep the orbiting end plate 45 in a constant orientation with respect to the stationary end plate 39. A downward protrusion 61L is formed in the lower surface of the Oldham's ring 61 to extend in the radial direction, while an upward protrusion (not shown in the figure) is formed on the upper surface of the ring 61 to extend in the direction perpendicular to the downward protrusion 61L. This downward protrusion 61L on the Oldham's ring 61 is slidably mated to the guide groove 63 formed in the bottom of the lower pressure chamber 59. The upward protrusion is slidably mated to the guide groove 65 formed in the first surface of the orbiting end plate 45. As will be explained below, this causes the second scroll wrap to move in such a way that the rotation of the orbiting end plate 45 compresses the gas that has been drawn in.

In addition, as is shown best in FIGS. 2(*a*) and (*b*), near the suction port 51 there is a guide valve or baffle 67 to guide the gas drawn in from the suction port 51 in the direction of the compression chambers 41. The guide valve 67, in this embodiment, consists of a leaf spring having a width nearly equal to the width of the orbiting scroll wrap 43, and has its base supported by the fixed end plate 39 through the pin 69 with its tip pressed up against the orbiting scroll wrap 43. Two guide valves 67 are shown, one adjacent each of the suction ports 51. The guide valves substantially isolate the suction chamber 37 surrounding the suction ports. Gas drawn through the suction tubes thus passes directly into the suction ports by the shortest path possible, there being little or no dead space for accumulation of gas, so that heating of the drawn gas is thereby minimized.

In the configuration described above, when the rotating shaft 25 is rotated by the rotation drive device 5, the eccentric section 25E of the rotating shaft 25 rotates eccentrically. Consequently, the orbiting end plate 45 is caused to revolve while its orientation is held constant by the Oldham's ring 61. The scroll wrap 43 attached to the orbiting end plate 45 is displaced in the up, down, left and right directions in FIGS. 2(*a*) and (*b*). At this time, when the second scroll wrap 43 is caused to rotate in the clockwise direction in FIGS. 2 (*a*) and (*b*), the multiple contact lines CP between the first scroll wrap 35 of the stationary end plate 39 and the second scroll wrap 43 of the orbiting end plate 45 move gradually from the outer circumference as shown FIGS. 2(*a*) and (*b*), causing the compression chambers 41 to gradually compress. Consequently, the gas inside the compression chambers 41 is compressed, and ejected from the discharge port 49 into the compression device chamber 9B.

The higher pressure gas ejected into the compression device chamber 9B passes through the through hole 13 into the drive chamber 9A and then is exhausted to the outside from the exhaust tube 15. At this time, the higher pressure gas contacts the baffle plate 19, and the oil contained in the gas is removed by adhering to the baffle plate before it is exhausted to the outside.

As explained above, when the drive device 5 causes the orbiting end plate 45 to revolve, compressing the gas, gas is drawn in from the suction port 51 through the suction tube 53. Since the suction port 51 is formed so that its diameter is relatively large, the flow path resistance becomes small and gas is effectively drawn in.

Since gas flows into the compression chambers 41 directly from the suction port 51, the gas is not heated, increasing the compression efficiency and the volume efficiency. Also, because the width of the guide valve is slightly less than the width of the orbiting scroll wrap 43, a small part of the gas which is drawn in from the suction port 51 flows into the lower pressure chamber 59 to maintain the lower pressure in the lower pressure chamber 59, while the larger part of the gas is guided by the guide valve 67 to the compression chamber 41, maintaining highly efficient suction and compression.

While preferred emodiments of this invention have been shown and described, it will be appreciated that other embodiments will become apparent to those skilled in the art upon reading this disclosure, and, therefore, the invention is not to be limited by the disclosed embodiments.

What is claimed is:

1. A scroll compressor comprising:

a sealed vessel;

a frame disposed inside said sealed vessel to rotatably support a rotating shaft and to partition the interior of said sealed vessel into a drive chamber and a compression device chamber, said rotating shaft being disposed within said drive chamber;

a stationary end plate which has an outer wall and a first scroll wrap radially inward of said outer wall and which is tightly fixed to said frame inside the sealed vessel;

an orbiting end plate engaged with said rotating shaft on a first surface thereof and movable thereby, said orbiting end plate having on a second surface opposite said first surface a second scroll wrap slidable against said first scroll wrap at a plurality of places to form a plurality of compression chambers; said compression chambers being centripetally rotated in correspondence with the movement of said orbiting end plate, said stationary end plate formed with at least one suction port opened at an outer peripheral portion of said stationary end plate so as to communicate with a suction chamber, and a discharge port substantially in the center of said stationary end plate to exhaust the compressed gas into said compression device chamber, said suction port being opened and closed by said movable second scroll wrap;

wherein said suction chamber is defined by said first and second scroll wraps, said stationary end plate and a baffle means attached at one end to said stationary end plate and at the other end slidingly contacts said second scroll wrap.

2. A scroll compressor as described in claim 1, wherein the number of said suction ports is two, wherein one of said suction ports is located close to the outer end of said second scroll wrap and the other is located on the opposite side of said discharge port.

3. A scroll compressor as described in claim 1, wherein the diameter of said suction port is at least substantially as large as the material thickness of said second scroll wrap, and said suction port is partly defined by a recessed portion formed in the compression chamber side wall which is one of said first scroll wrap and said outer wall of said stationary end plate.

4. A scroll compressor as described in claim 1, wherein said baffle means contacts the second scroll wrap and follow its motion, thereby preventing gas from the suction port from flowing outside the compression chambers.

5. A scroll compressor as described in claim 1, wherein the suction port has an opening straddling a first surface of the stationary end plate facing the compression perpendicular to the first surface, wherein said suction port is connected to a suction tube extending from the second surface opposite to the first surface of the stationary end plate to said suction port, and wherein the second scroll wrap covers said opening to stop gas from being drawn in and opens said opening to draw gas into the compression chambers.

6. A scroll compressor as described in claim 5, wherein a low pressure chamber is provided on the opposite side of the orbiting end plate from said second scroll wrap to accomodate an Oldham's ring, said low pressure chamber being communicated with the outermost circumference of said second scroll wrap so that a small amount of the drawn gas enters said low pressure chamber.

7. A scroll compressor as described in claim 5, wherein said baffle means in contact with the second scroll wrap at the other end so as to follow the movement of the second scroll wrap, thereby preventing drawn gas which leaves the suction port from flowing out of the compression chambers.

8. A scroll compressor as claimed in claim 5, wherein said suction tube provides a direct path for said drawn gas from a source outside said scroll compressor to said suction port.

9. A scroll compressor, comprising:

a sealed vessel;

a frame disposed inside said sealed vessel to support a rotatable shaft and to partition the interior of said sealed vessel into a drive chamber and a compression device chamber;

a stationary end plate which has an outer wall and a first scroll wrap radially inward of said outer wall and which is tightly fixed to said frame inside the sealed vessel;

an orbiting end plate engaged with said rotating shaft on a first side and having a second scroll wrap on a second side cooperating with said first scroll wrap, said scroll wraps forming thereby at least one suction chamber and a plurality of compression chambers;

at least one suction port for receiving a drawn gas and means for intermittently placing said suction port in fluid communication with said suction chamber;

means for providing a direct path for a gas drawn from said suction port to said suction chamber;

means for rotating said rotatable shaft to slide said second scroll wrap against said first scroll wrap, said drawn gas thereby being compressed in said compression chambers;

a discharge port for ejection of said compressed gas from said compression chambers; and a guide valve being associated with said suction chamber and, together with said orbiting and stationary scroll wraps, defining said suction chamber, said guide valve having one end secured to said stationary plate and the other end engaging a radially outward end of said second scroll wrap, said guide valve including a leaf spring having a width less than the width of said second scroll wrap, said guide valve forming thereby a guide for passage of said drawn air into said suction chamber.

10. A scroll compressor as described in claim 9, wherein said scroll compressor includes a lower pressure chamber positioned behind said first side of said orbiting end plate, said lower pressure chamber communicating with said suction chamber.

11. A scroll compressor as described in claim 9, wherein said suction port has an opening straddling one of said outer wall and a wall of said first scroll wrap, and wherein said suction port is intermittently sealed by said second scroll wrap abutting respectively said outer wall or said wall of said first scroll wrap as said second wrap slides against said first wrap.

* * * * *